US009196435B2

(12) United States Patent
Ely et al.

(10) Patent No.: US 9,196,435 B2
(45) Date of Patent: Nov. 24, 2015

(54) TUNED SWITCH SYSTEM

(71) Applicant: Apple Inc., Cupertino, CA (US)

(72) Inventors: Colin M. Ely, Cupertino, CA (US); Fletcher R. Rothkopf, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 125 days.

(21) Appl. No.: 13/937,416

(22) Filed: Jul. 9, 2013

(65) Prior Publication Data

US 2014/0069793 A1 Mar. 13, 2014

Related U.S. Application Data

(60) Provisional application No. 61/700,880, filed on Sep. 13, 2012.

(51) Int. Cl.
*H01H 13/14* (2006.01)
*H01H 13/85* (2006.01)

(52) U.S. Cl.
CPC ..... *H01H 13/85* (2013.01); *H01H 2215/004* (2013.01)

(58) Field of Classification Search
CPC ..... H01H 13/702–13/705; H01H 13/7065; H01H 13/7073; H01H 13/85
USPC ..... 200/5 A, 520, 521
See application file for complete search history.

(56) References Cited

U.S. PATENT DOCUMENTS

| | | | | |
|---|---|---|---|---|
| 4,127,752 | A * | 11/1978 | Lowthorp | 200/5 A |
| 4,684,767 | A | 8/1987 | Phalen | |
| 4,803,316 | A | 2/1989 | Hayashi et al. | |
| 5,909,804 | A * | 6/1999 | Kuratani | 200/516 |
| 7,523,679 | B2 * | 4/2009 | Hawes et al. | 73/862.381 |
| 8,258,418 | B2 | 9/2012 | Chen | |
| 8,269,124 | B2 | 9/2012 | Jung et al. | |
| 2012/0305372 | A1 | 12/2012 | Bigand | |
| 2013/0075241 | A1 | 3/2013 | Prest et al. | |

* cited by examiner

*Primary Examiner* — Vanessa Girardi
(74) *Attorney, Agent, or Firm* — Downey Brand LLP

(57) ABSTRACT

The described embodiments relate to methods and apparatus for fine-tuning a resistance profile for a mechanical switch. In one embodiment, by combining a switch with one or more damping or support materials a tuned switch system can be formed. The damping or support materials can modify the force and displacement characteristics of the switch, thereby allowing a user experience to be customized. The damping or support materials can be arranged in series and/or in parallel with the mechanical switch.

17 Claims, 11 Drawing Sheets

Combination Dome switch/silicon damper in series

Combination Dome switch/silicon dampers in parallel

TUNED SWITCH SYSTEM

CROSS REFERENCE TO RELATED APPLICATIONS

This U.S. Patent Application claims priority under 35 USC §119(e) to U.S. Provisional Patent Application No. 61/700,880 filed Sep. 13, 2012 entitled "Assembly of Electronic Device" by Ely et al. which is incorporated by reference in its entirety for all purposes.

BACKGROUND

1. Technical Field

The described embodiments relate generally to electronic devices and more particularly to forming dust gaskets and tuned switch systems.

2. Related Art

Electronic devices often include controls for receiving a user input. A response profile for a given control can have a great effect on how a user interacts with that device. A dome switch is one particular type of control that gives a user a clear tactile response indicating that a button has been actuated. Unfortunately, in some cases the operational feel of a particular off the shelf dome switch can be somewhat different from a desired operational feel. In some cases an overall displacement of the button can be shorter than desired. In other cases it can be desirable for a control to provide a stronger resistance profile. In some cases operational responses of a number of switches disposed in a single device can be noticeably different due to a layout of the switches with respect to a received user input region.

Therefore, what is desired a way to control the tactile response provided by one or more switches.

SUMMARY

This paper describes various embodiments that relate to apparatus and systems for customizing a force response associated with a dome switch.

In a first embodiment a mechanical switch system is disclosed. The mechanical switch system is configured to provide a customized response to a user input. The mechanical switch system includes at least a dome switch and a tunable feature. The dome switch is configured to provide a first response to an external force and the tunable feature is characterized as having a second response to the external force. When the user input is received by the mechanical switch system the second response of the tunable feature combines with the first response of the dome switch to provide the customized response to the user input.

In another embodiment a pressure actuated controller is disclosed. The pressure actuated controller is configured to provide a normalized response to a number of user inputs. The pressure actuated controller includes at least a number of dome switches and a tunable feature. The dome switches are each configured to provide a fixed response to an external force. The tunable feature cooperates with each of the dome switches to provide the normalized response to actuation of any of the dome switches. The tunable feature includes a flexible button top and a number of deformable members. The flexible button top is configured to receive an actuation input for any of the dome switches, while the deformable members are disposed proximate to the dome switches and in direct contact with the flexible button top. The tunable feature at least partially normalizes a response associated with actuation of each of the dome switches.

In yet another embodiment a tuned switch having a customized response profile is disclosed. The tuned switch includes at least a dome switch and a tunable feature. The dome switch is configured to provide a fixed response to an external force. The tunable feature is configured to provide a linear response to the external force that is combined with the fixed response of the dome switch to provide the customized response profile. The tunable feature includes at least a first deformable member arranged in series with the dome switch, and a second deformable member arranged in parallel with the dome switch. The first and second deformable members of the tunable feature cooperate to increase a force and travel distance of the dome switch associated with actuation of the tuned switch.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION OF SELECTED EMBODIMENTS

Figure 1A:
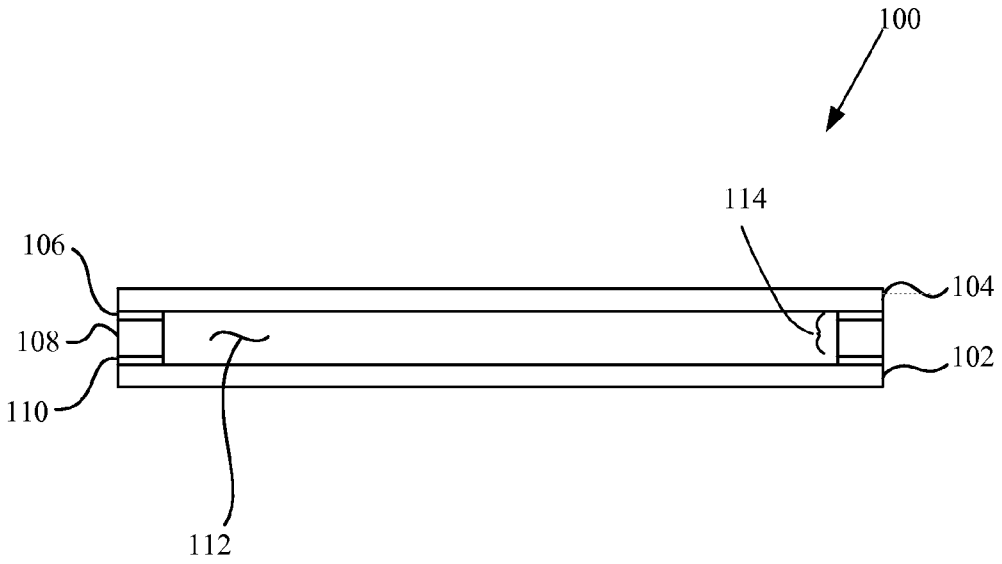
FIG. 1A is a block diagram of a cross sectional view of a stack up including two substrates and a dust gasket.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

In many situations a dome switch can be utilized to provide a user feedback in response to a provided input. While a dome switch is generally configured to reduce its resistance once a user has provided sufficient force to actuate an electrical contact associated with the dome switch, in some instances the resistance profile associated with the dome switch can be different than what is desired for a given application. In such an instance a tunable feature can be combined with the dome switch to form a switch system that can have a customized force resistance profile in accordance with the particular application.

The tunable feature can include one or more deformable members configured to cooperate with the dome switch to alter the provided user feedback. The deformable members can be made of any material that allows the deformable member to be compressed. In some embodiments the deformable member has a substantially linear response profile, meaning that as it is compressed it provides a proportionately greater resistance as the deformable member is compressed. It other embodiments the deformable member can have a non-linear response profile. In some implementations the non-linear response profile can be configured to substantially alter the resulting customized response profile of the switch system. Furthermore, the deformable member or members of the tunable feature can be arranged in parallel or in series with the dome switch. When the deformable members of the tunable feature are arranged in series with respect to the dome switch they tend to increase an amount of compression that can be accepted by the resulting switch system, effectively lengthening the travel distance of the switch system in response to the user input. When the deformable members of the tunable feature are arranged in series with respect to the dome switch the overall resistance of the tunable feature is added to the resistance of the dome switch, thereby causing a resistance of the switch system to increase without necessarily adding to the travel of the system. In still other embodiments the tunable feature can include some deformable members disposed in series with the dome switch and other deformable members disposed in parallel with the dome switch. In this way both switch system travel and resistance can be adjusted as desired.

In another more specific embodiment a tuned switch system can include a number of dome switches that allow a user to provide a number of different inputs to the tuned switch system. By adding deformable members in parallel and/or in series with the dome switches a resistance profile of inputs associated with each dome switch can be substantially normalized. By normalized it is meant that a user of the tuned switch system can experience a substantially similar force resistance profile in response to actuation of each of the various dome switches disposed within the tuned switch system.

These and other embodiments are discussed below with reference to FIGS. 1A-13; however, those skilled in the art will readily appreciate that the detailed description given herein with respect to these figures is for explanatory purposes only and should not be construed as limiting.

FIG. 1A is a cross sectional view of a stack up 100 including two substrates and a dust gasket 114. In one embodiment a first substrate 102 can be a display, such as liquid crystal display used in a portable computing device, portable communication device, portable music player or the like. A second substrate 104 can be a touch panel, a cover glass, a plastic shield or any other substrate. Typically, the second substrate 104 is substantially translucent or transparent enabling the user to view the first substrate 102, particularly when the first substrate 102 is a display.

A sealed airspace 112 can be formed between first substrate 102 and second substrate 104 with dust gasket 114. Dust gasket 114 is operable to prevent the introduction of contaminates between first substrate 102 and second substrate 104. In one embodiment, the dust gasket 114 can form a continuous and compliant seal and be disposed around a perimeter of the first substrate 102. In some embodiments an amount of compression exerted by the substrates onto gasket 114 can be sufficient to hold the gasket firmly in place during use of an associated device; however, as designs minimizing the space between the two substrates are implemented machining tolerances can force gasket 114 to accommodate a more highly variable amount of compression. For example, in an embodiment where gasket 114 is 1 mm and there is a tolerance of 0.2 mm the gasket should be configured to contract or expand by about 20%. In order to cut the height of gasket 114 in half to, for example, 0.5 mm without implementing costly changes to manufacturing tolerances, gasket 114 would accommodate a height of between 0.3 and 0.7 mm given the same 0.2 mm tolerances. Accordingly, the gasket would need to be configured to expand and contract by about 40%. Foam that can accommodate a 40% expansion and contraction is generally made of lower density foam than one that can accommodate only 20% expansion and contraction.

Figure 1B:
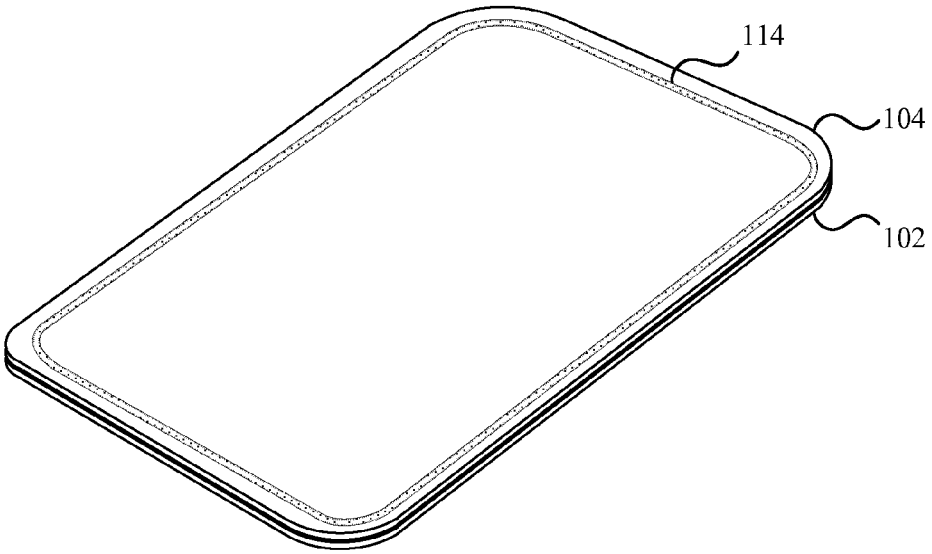
FIG. 1B is a perspective view of the two substrates and dust gasket depicted in FIG. 1A.

Because high-density foam can be configured to receive more force than low-density foam, a configuration with low-density foam can be under a respectively lower amount of compression. For this reason, compressive forces acting on the low-density foam can be insufficient to maintain first substrate 102 in position with respect to second substrate 104. To maintain the gasket in position with respect to the substrates the gasket can be adhesively attached to both first substrate 102 and second substrate 104. FIG. 1A shows how dust gasket 114 can include a first layer of adhesive 106, a layer of foam 108 and a second layer of adhesive 110. The layer of foam 108 can be low-density foam and thereby allow a greater range of compression compared to high-density foam. In another embodiment, the dust gasket 114 can be a composite of the three layers (first adhesive 106, foam 108, second adhesive 110) as shown. In another embodiment, the dust gasket 114 can be formed from a layer of foam that has been impregnated with an adhesive. In yet another embodiment, an adhesive layer can include three layers: an adhesive layer, a carrier layer, and an adhesive layer. Thus, the composite dust gasket 114 can ultimately be seven layers: three layers for the first adhesive layer, one layer of foam and three more layers of the second adhesive layer. FIG. 1B show a perspective view of stackup 100. The perspective view shows how gasket 114 can be visible through transparent second substrate 104. Since dust gasket 114 runs along a peripheral portion of the first and second substrates it can operate to keep substantially all foreign particles from being introduced between the two substrates.

Figure 2:
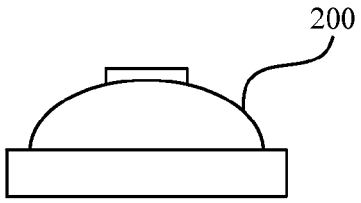
FIG. 2 is an illustration of a dome switch.
Figure 3:
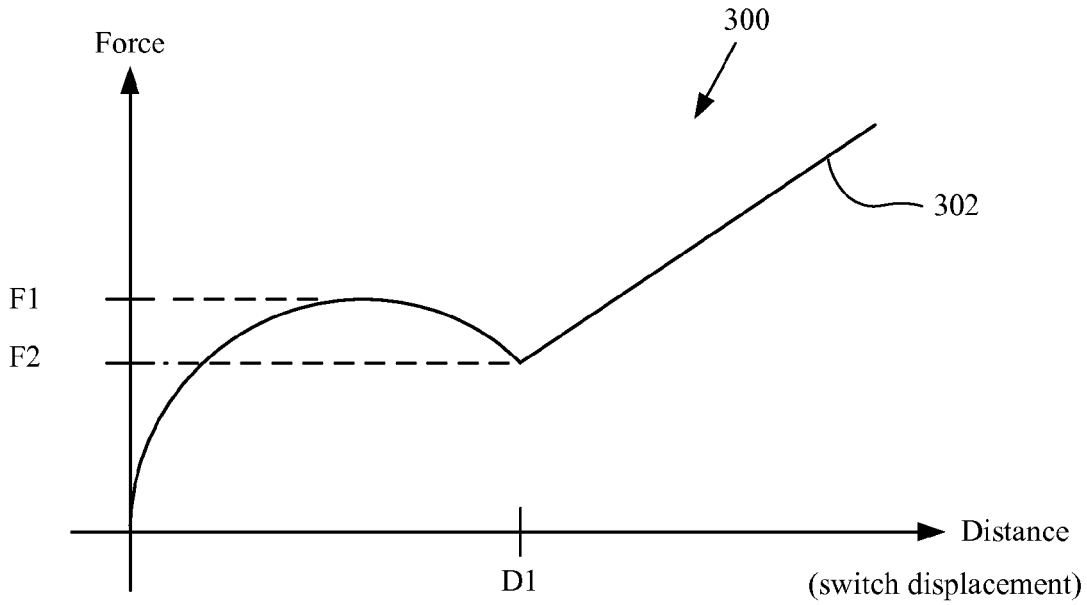
FIG. 3 is a force distance graph for the dome switch shown in FIG. 2.

FIG. 2 is an illustration of a dome switch 200. Dome switch 200 can have an associated force required to actuate switch 200. Typically, the actuation force can be applied over a distance. The force and the distance together can define a user tactile experience. FIG. 3 is a force-distance graph 300 for dome switch 200 that represents a resistance profile provided by dome switch 200. The force curve 302 can start near zero (near the origin of the graph 300) and increase to a first force F1. The force curve starts to decrease to a local minimum of F2 shown at distance D1. Distance D1 can be the distance required to actuate dome switch 200. The user can experience a "click" at this traveled distance that corresponds to the force F2, experienced by the user. The difference between force F1 and force F2 can be referred to as a click ratio. The force can increase after distance D1. The force increase at D1 can be configured with varying slopes to provide a firm stop against which further displacement is increasingly difficult.

Figure 4A:
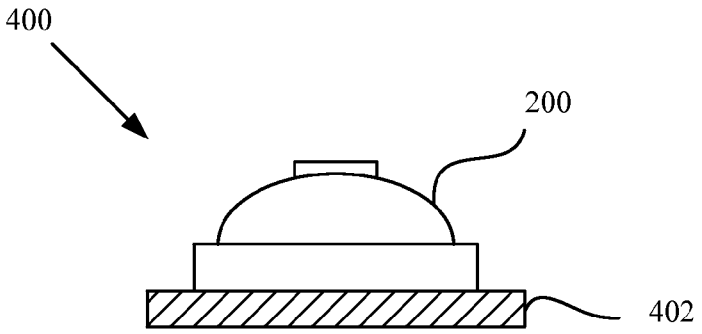
FIG. 4A is an illustration of a dome switch arranged in series with a deformable member.
Figure 4B:
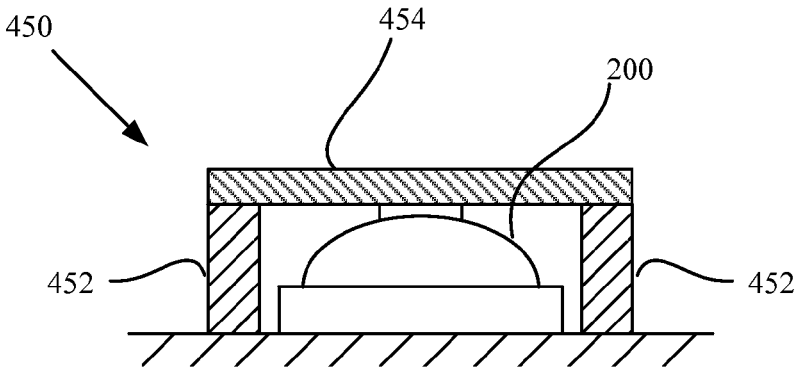
FIG. 4B is an illustration of a dome switch arranged in parallel with deformable members.

In some applications, a designer may wish to tune or modify the user tactile experience of dome switch 200. For example, the designer may want to change the click ratio associated with an obtained dome switch 200. In one embodiment a resistance profile provided by dome switch 200 can be adjusted by combining it in series or in parallel with another resistance profile provided by another object to obtain a mechanical switch or tuned switch system having a desired resistance profile. FIG. 4A shows a tuned switch system 400 including a dome switch 200 and a silicon damper 402 arranged in series. In this exemplary embodiment, silicon damper 402 is positioned beneath dome switch 200. In another embodiment, the silicon damper 402 can be positioned above dome switch 200. In some embodiments a silicon damper 402 disposed above dome switch 200 can be substantially smaller than one disposed below silicon damper 402. FIG. 4B shows a tuned switch system 450 arranged in parallel with silicon dampers 452. In some embodiments top portions of silicon dampers 452 and dome switch 200 can each be in contact with metal shim 454. In embodiments where metal shim 454 is substantially rigid a resistance profile associated with each can be substantially additive as will be shown in FIGS. 5B and 6B. It should be noted that in some embodiments silicon dampers 402 can be replaced with spring bodies. In some applications a spring can provide a more consistent resistant profile than a silicon pad or damper. It should be further noted that silicon dampers 452 can include any deformable member configured to be elastically deformed in response to a user input. Consequently, use of terms such as silicon pad, silicon damper or spring should not be construed as limiting the scope of this disclosure.

Figure 5A:
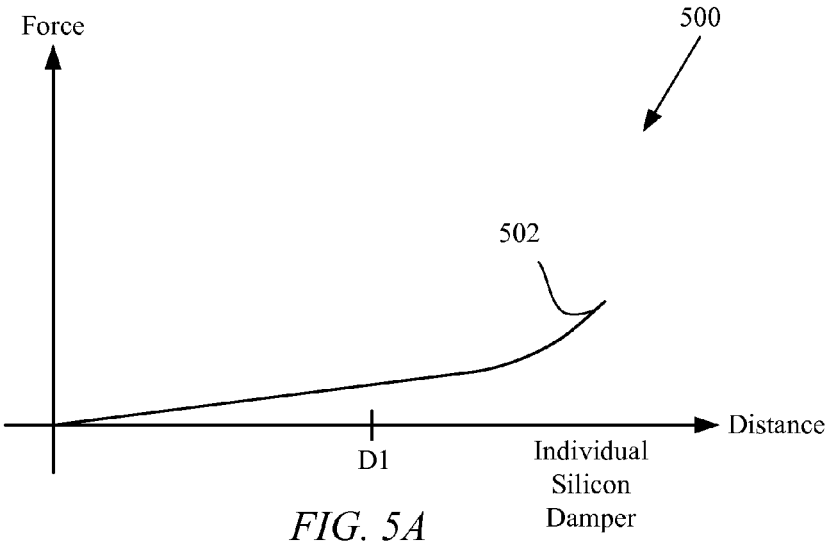
FIG. 5A is a force distance graph of a force response profile associated with a deformable member.
Figure 5B:
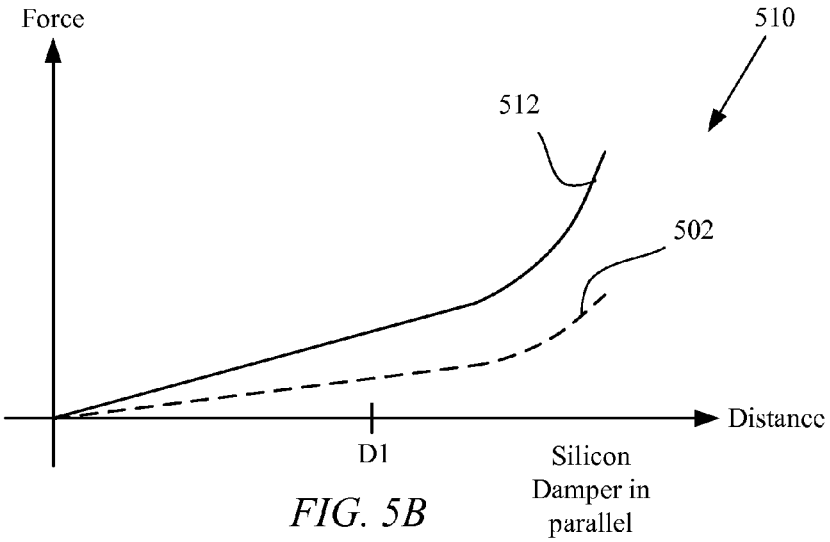
FIG. 5B is a force distance graph showing a resulting force response profile associated with two deformable members arranged in parallel.

FIG. 5A is a force distance graph 500 of a single deformable member, which can be embodied as a silicon pad or damper. The force curve 502 shows a substantially linear relationship, particularly through distance D1. After a distance greater than D1, the force can increase non-linearly. FIG. 5B shows a force curve 504 representing a pair of silicon pads or dampers arranged in parallel. A stiffness provided by a pair of silicon pads arranged in series can be approximated in accordance with Eq. (1) below. The resulting force as a function of displacement x and $k_{System}$ can be approximated as a function of Hooke's law, see Eq. (2) below.

$$k_{system}=k_1+k_2 \quad \text{Eq. (1)}$$

$$F=k_{System}x \quad \text{Eq. (2)}$$

Figure 5C:
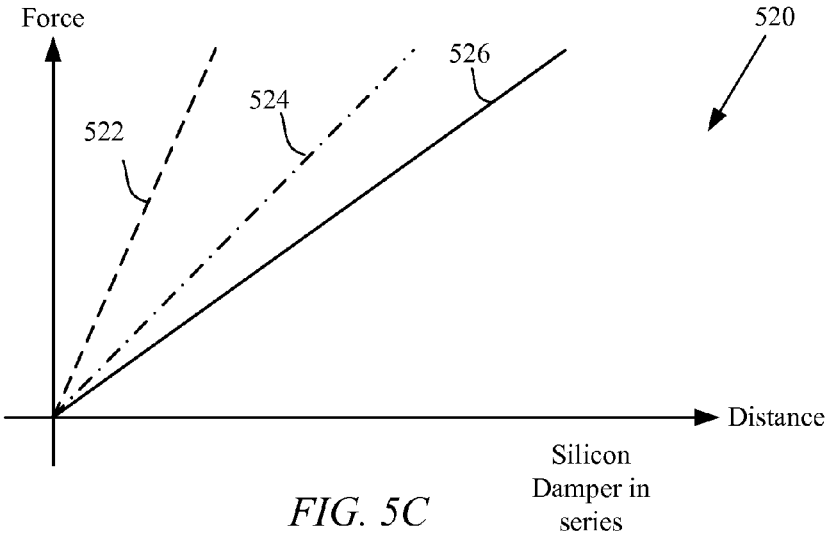
FIG. 5C is a force distance graph showing a resulting force response profile associated with two deformable members having different compressibility attributes, arranged in series.

$k_{System}$ represents an overall stiffness value of the dampers arranged in parallel. The stiffness value $k_{System}$ corresponds to a slope of the force curve 512 as approximated by Eq. (2). Accordingly, placing the two dampers in parallel essentially doubles the linear slope of force curve 504 with respect to force curve 502, which represents each of two silicon dampers arranged in parallel. FIG. 5C shows force curve 522 and 524 representing two silicon pads or dampers having different stiffness values $k_1$ and $k_2$. When the two silicon pads or dampers are placed in series, a resulting force curve 526 has a lower stiffness than either one of the two pads or dampers, as is shown by Eq. (3) below, and depicted by force curve 526 in FIG. 5C.

$$\frac{1}{k_{System}} = \frac{1}{k_1} + \frac{1}{k_2} \quad \text{Eq. (3)}$$

Figure 6A:
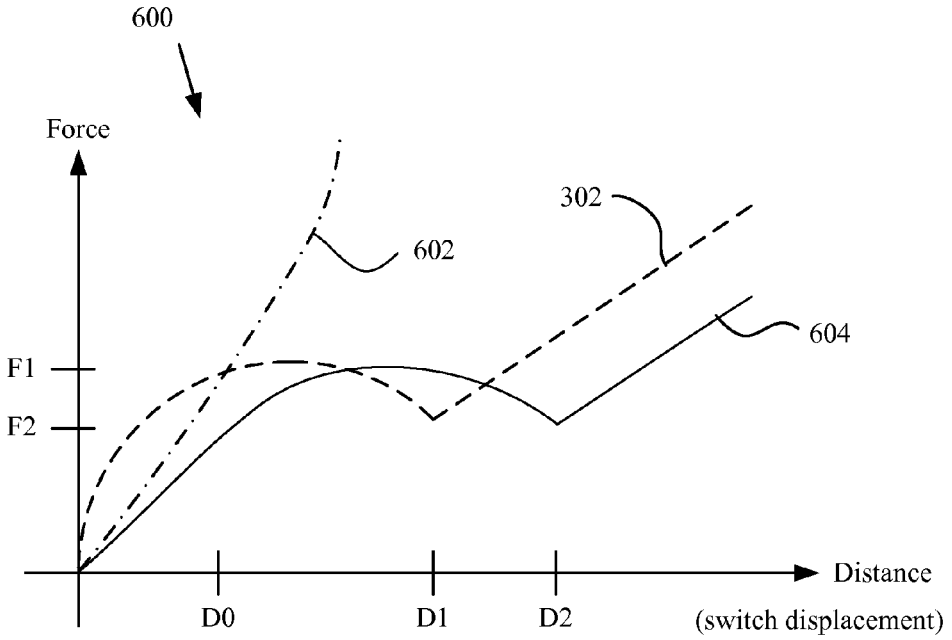
FIG. 6A is a force graph of a tuned switch system that includes a dome switch and a deformable member arranged in series.

FIG. 6A is a force distance graph 600 of tuned switch system 400. In FIG. 6A, force curve 302 of dome switch 200 is depicted with a dashed line. Force curve 602 of silicon damper 402 is also shown with a dotted line. The combined force curves can result in force curve 604. Such a configuration causes the travel of the dome switch to change from a distance D1 to a distance D2. In addition to a change in the travel of the dome switch the slope of the curve between maximum force F1 and force F2 is more gradual, providing a different feel to the button actuation even though the click ratio itself can in this case remain the same. In this way, a user's tactile experience with dome switch 200 can be modified by combining other materials in series with dome switch 200. Series combinations, as is depicted, can be especially useful for lengthening the travel of a particular switch system.

Figure 6B:
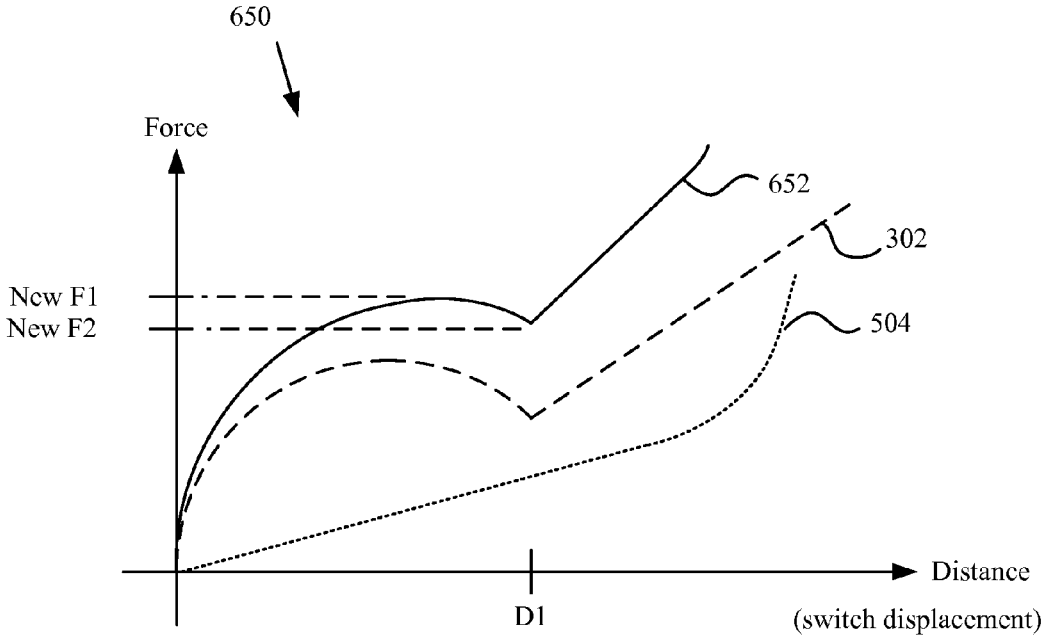
FIG. 6B is a force graph of a tuned switch system that includes a dome switch and a deformable member arranged in parallel.

FIG. 6B is a force distance graph 650 of tuned switch system 450. In this embodiment, the force distance graph 650 can be a linear combination of force distance curve 302 of dome switch 200 and force curve 504 representing two silicon pads or dampers arranged in parallel. Because tuned switch system 450 is arranged in parallel, resulting force distance curve 652 is essentially an addition of the two force curves. It should be noted that in some cases silicon dampers and dome switches can be arranged both in parallel and in series in any number of different configurations.

In other embodiments, other materials can be used in combination with dome switch 200 to modify force curve 302 and change the user tactile experience. For example, instead of a silicon damper 502, a more compliant damper such as plastic or rubber damper can be used. A plastic or rubber damper can increase the deflection that the user exerts on the switch, effectively increasing the detent or click distance D1. In another embodiment a number of different materials can be arranged in parallel to vary feedback provided to a user. In still other configurations, materials having substantially different resistances to an input can be utilized. Thus, the force curve 302 can be modified by using any feasible material in combination with dome switch 200. In one embodiment, additional material can effectively add a second force curve in parallel with force curve 302. The additional material can be disposed above or below dome switch 200.

Figure 7A:
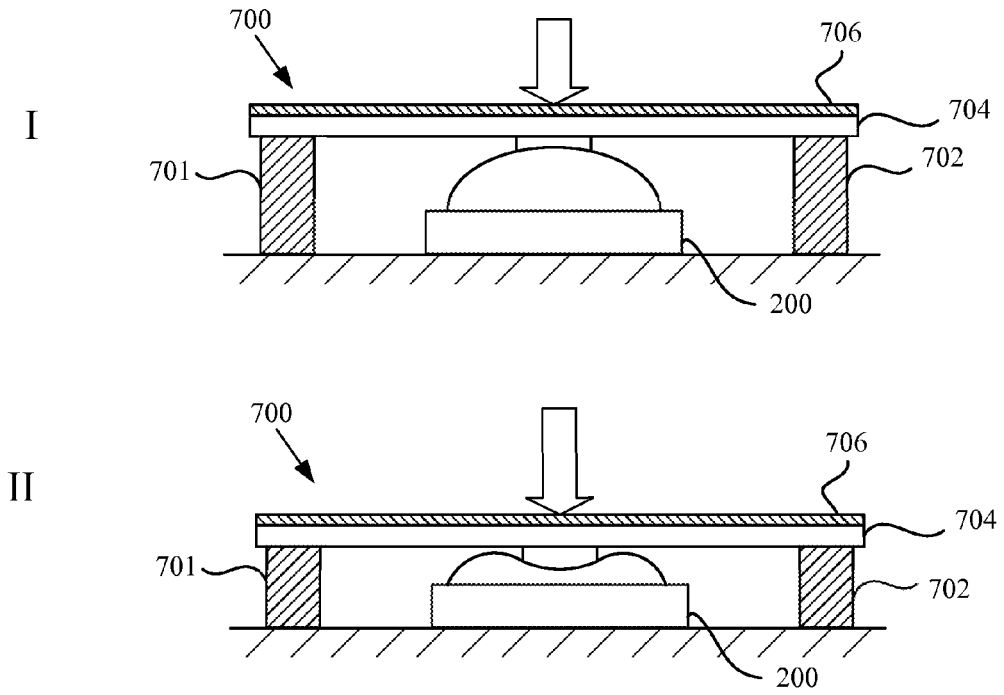
FIGS. 7A-7B show various configurations of a tuned switch system having a number of deformable members arranged in parallel with a dome switch.
Figure 7B:
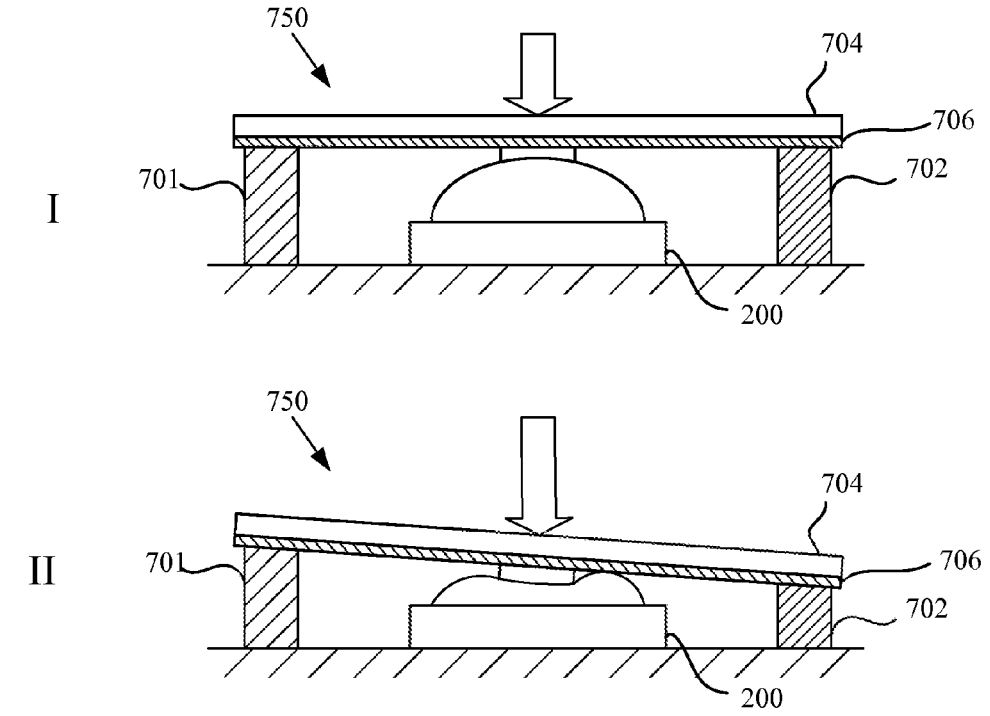

FIG. 7A is another embodiment of a tuned switch system 700. FIG. 7A shows tuned switch system 700 in an un-depressed state I and a depressed state II. In this embodiment, dome switch 200 is disposed beneath a metal shim 704 in combination with a plastic layer 706. Supporting the metal shim 704 and plastic layer 706 can be foam blocks 701 and 702. The foam blocks 701 and 702 can add a resistance force in parallel with the dome switch 200. The metal shim 704 and plastic layer 706 can add resistance forces in series with dome switch 200. In other embodiments, foam blocks 701 and 702 need not be identical, but rather one of the foam blocks can be replaced by a different material. In this way, foam blocks 701 and 702 can have different compressibility attributes leading to a modified user tactile experience. The resulting user tactile experience can be determined by combining the respective force curves for the respective elements in tuned switch system 700. FIG. 7B shows another configuration of tuned switch system 700 in an un-depressed state I and a depressed state II, in which plastic layer 706 is added beneath shim 704. In this configuration given a rigid shim 704, plastic layer 706 can be added in series with blocks 701 and 702 along with dome switch 200. Plastic layer 706 can be made from soft plastic, thereby making it another deformable member or more specifically a deformable layer in this depiction.

Figure 8:
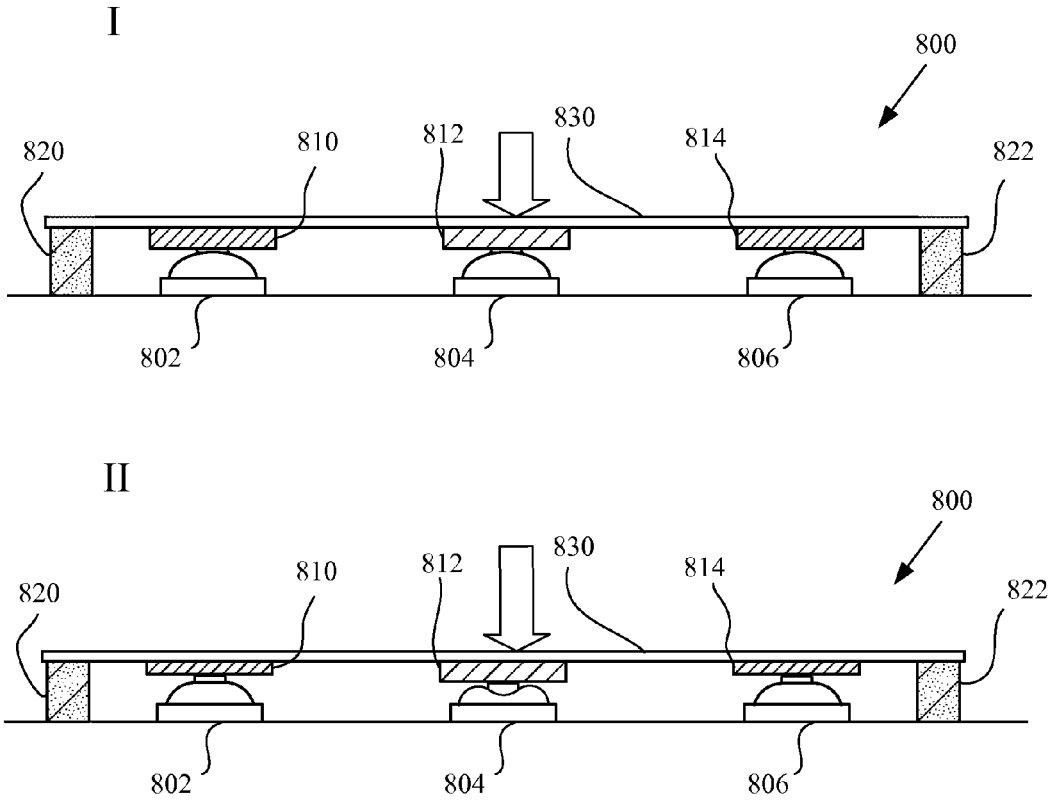
FIG. 8 shows a tuned switch system configured to provide normalized responses corresponding to each of a number of dome switches disposed within the tuned switch system.

FIG. 8 is yet another embodiment of a tuned switch system 800 shown in an un-depressed state I and a depressed state II. This system 800 can include three switches 802, 804 and 806 as shown. In one embodiment, the three switches can be dome switches 200. Disposed over first switch 802 can be a first damper 812. Similarly a second damper 812 can be disposed over second switch 804 and a third damper 814 can be disposed over third switch 806. A flexible shim 830 can be disposed over switches 802, 804, and 806. The shim 830 can be supported on each end of switch system 800 by a first support 820 and a second support 822. In one embodiment the dampers 810, 812, and 814 can be silicon dampers while the supports 820 and 822 can be foam. In other embodiments, the dampers, supports and shims can be made from any technically feasible material.

Since shim 830 is a flexible shim, supported on each end, a deflection force needed to actuate switch 804 can be less than a deflection force needed to actuate switch 802 or 806 (the force may be attributed to a lever force determined by a distance from a fulcrum, in this case the supports 820 and 822 acting as fulcrums). One way to tune the user tactile experience is to use different damping material for dampers 810, 812 and 814 as illustrated. In one embodiment, a stiffer damper can be used for damper 812 while a more compliant damper can be used for damper 810 and 814. In another embodiment, a thickness of shim 830 can be variable. In yet another embodiment, supports 820 and 822 can be selected to change the user tactile experience. A force profile provided by switch 804 can also be adjusted to normalize resistance encountered by a user during actuation of each of the switches.

Figure 9:
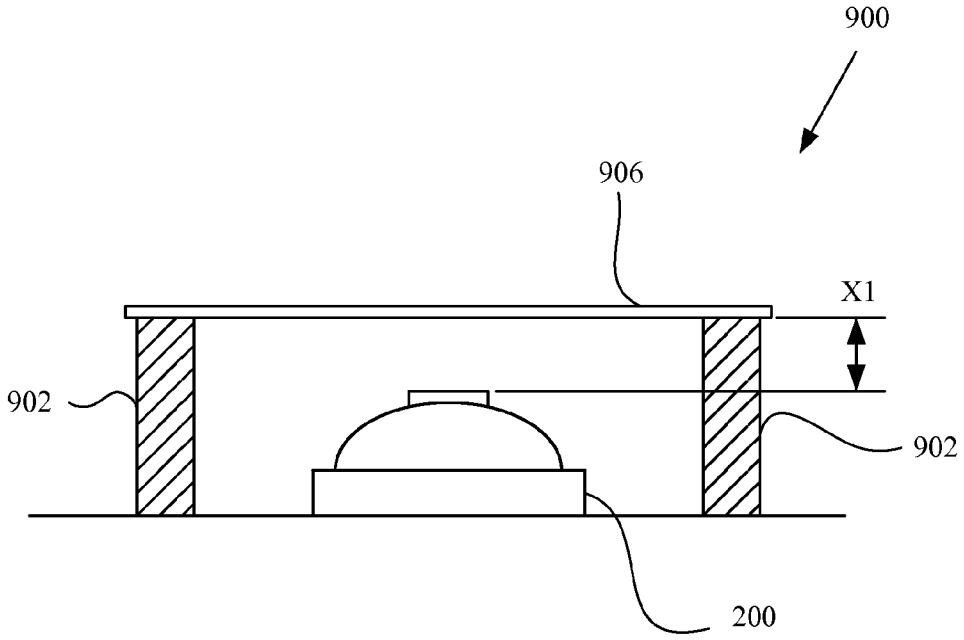
FIG. 9 shows a tuned switch system having a button top supported by at least two deformable members a distance above a dome switch disposed within the tuned switch system.
Figure 10:
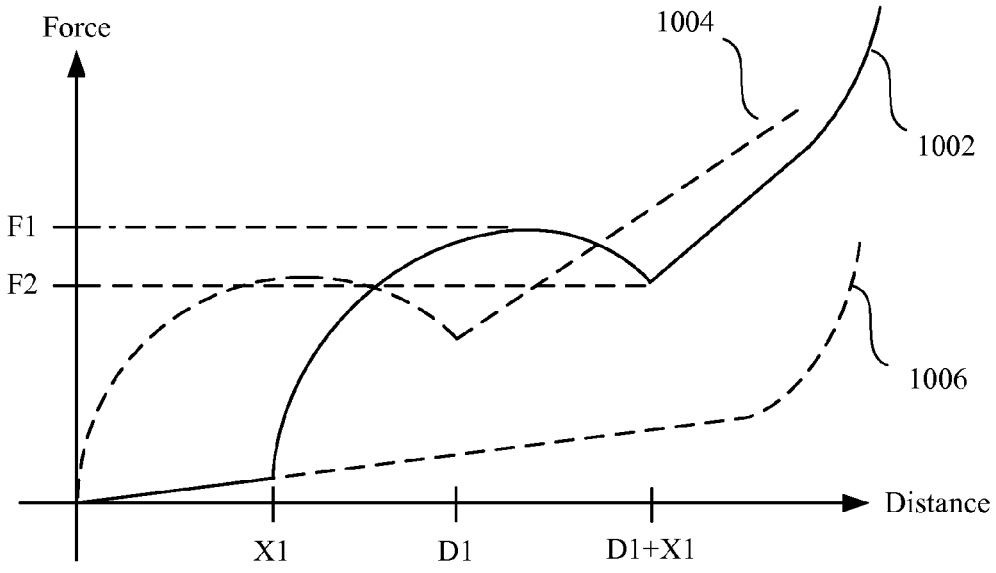
FIG. 10 is a force distance graph showing a force curve for the tuned switch system of FIG. 9.

FIG. 9 is yet another embodiment of a tuned switch system 900. In this embodiment, dome switch 200 is disposed under shim 906 supported by supports 902. It should be noted that in some embodiments shim 906 can function as a button top for receiving a user input. In this particular embodiment, a top surface of dome switch 200 is not in contact with a bottom surface of shim 906. Thus, an extra distance X1 is traversed before shim 906 contacts dome switch 200. In this way additional travel can be provided, thereby changing a user's tactile experience with respect to what dome switch 200 would provide on a standalone basis. In this embodiment, supports 902 can provide a substantially linear feedback to the user until shim 906 comes into contact with the top surface of dome switch 200 at a displacement value of X1 as depicted. It should be noted that while only two supports 902 are depicted, supports 902 can be disposed all around a periphery of dome switch 200, thereby stabilizing shim or button top 906 in place. FIG. 10 is a force distance graph 1000 showing a force curve 1002 for tuned switch system 900. Force curve 1002 has components of force curve 1004 representing a standalone force profile of dome switch 200, and force curve 1006 representing supports 902 arranged in parallel. As shown, an amount of actuation corresponding to the actuation of dome switch 200 is shifted from D1 to D1+X1. Force curve 1004 is shifted to the right since dome switch 200 is not contacted by shim 906 until displacement has reached a distance X1. A difference between forces F1 and F2 is also increased as a function of the gradually increasing force profile provided by force curve 1006.

Figure 11:
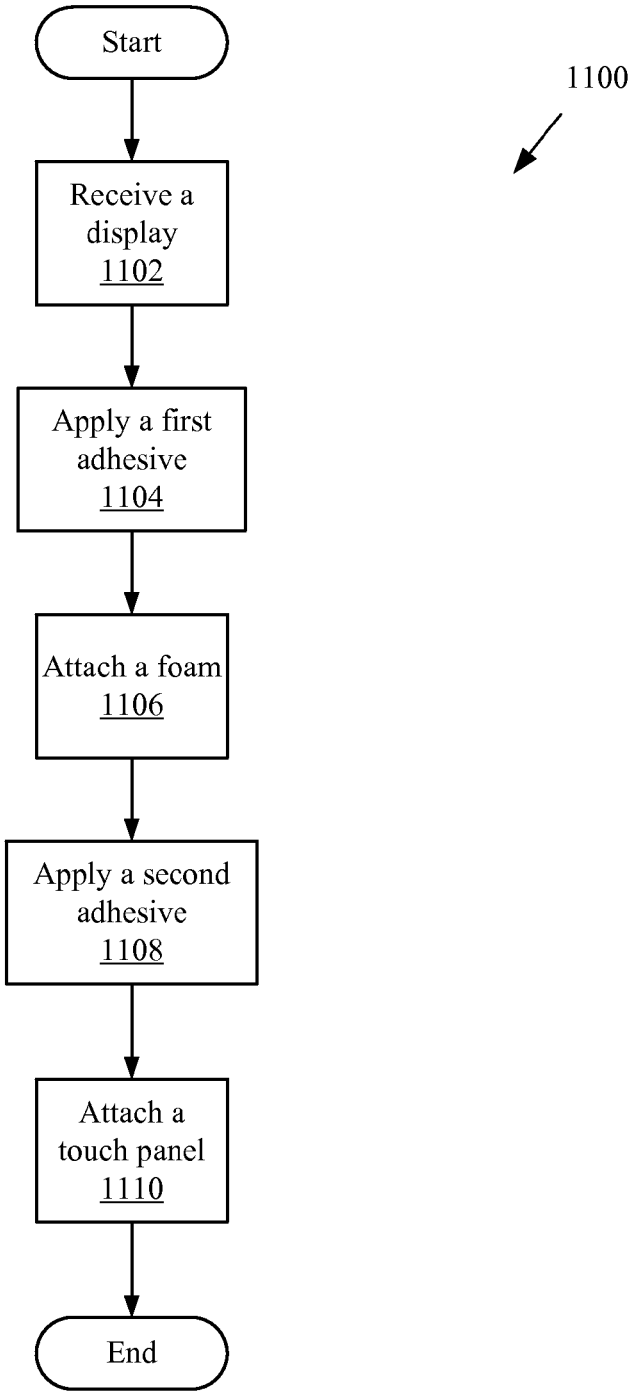
FIG. 11 is a flow chart of method steps for forming a seal between a display and a touch panel.

FIG. 11 is a flow chart of method steps 1100 for forming a seal between a display and a touch panel. The method begins in step 1102 when a display is obtained. In step 1104, a first layer of adhesive can be applied to the display. In one embodiment, the adhesive is applied around the perimeter of the display. In step 1106, low-density foam can be applied to the adhesive. In step 1108, a second layer of adhesive can be applied to the foam. In step 1110, a touch panel can be disposed on the second layer of adhesive and the method ends. It should be noted that in some embodiments the low-density foam can be preconfigured with adhesive to decrease a number of steps taken to attach the display to the touch panel. One way to pre-attach the adhesive is to use double sided pressure sensitive adhesive (PSA) on each of a top and bottom surface of the low-density foam. In this way a piece of coverlay can be removed from each of the pieces of PSA at which point the foam can be adhesively attached to both the display and touch panel in quick succession.

Figure 12:
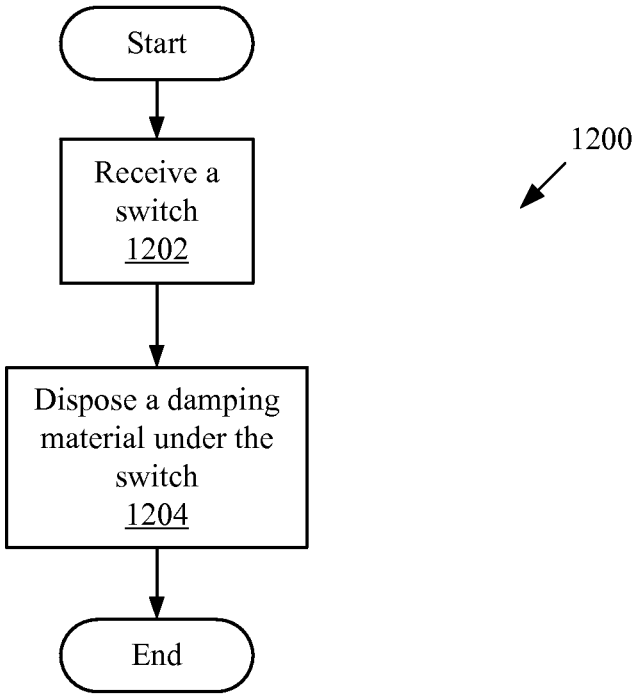
FIG. 12 is a flow chart of method steps for forming a tuned switch system having a deformable member arranged in series with a dome switch.
Figure 13:
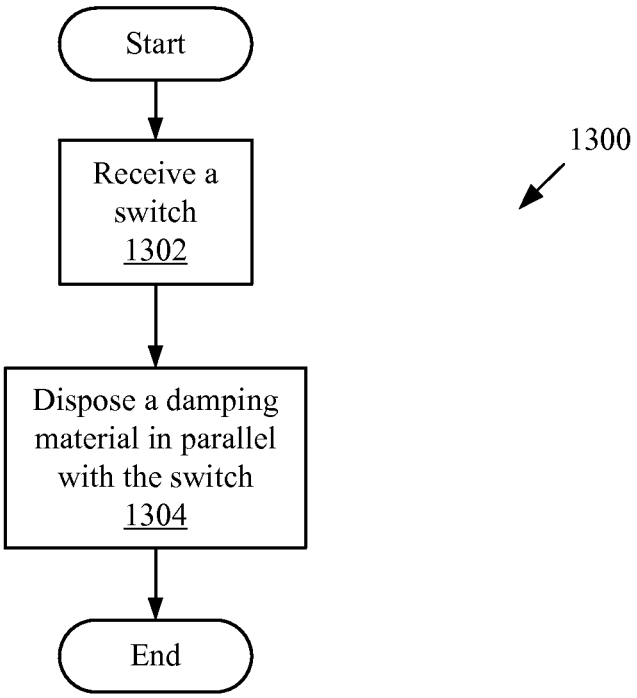
FIG. 13 is a flow chart of method steps for forming a tuned switch system having deformable members arranged in parallel with a dome switch.

FIG. 12 is a flow chart of method steps 1200 for forming a tuned switch system. The method begins in step 1202 when a switch is received. In step 1204, a damping material can be disposed under the switch and the method ends. FIG. 13 is a flow chart of method steps 1300 for forming a tuned switch system. The method begins in step 1302 when a switch is received. In step 1304, at least one piece of damping material can be disposed laterally with respect to the switch, such that the damping material experiences an equal amount of compression as the switch when the switch is activated. It should be noted that the steps disclosed in methods 1200 can be used discretely or in conjunction. By using the methods in conjunction, a response profile generated by a tuned switch system can be more complexly modified, as depicted in FIGS. 7 and 8.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A tuned switch having a customized response, comprising:

a dome switch;

a first deformable member arranged in parallel with the dome switch;

a second deformable member arranged in parallel with the dome switch and providing a substantially different amount of resistance than the first deformable member in response to a force received by the tuned switch; and a shim supported by the first and second deformable members and configured to distribute a force received by the shim to the first and second members, wherein when the force is received, the shim compresses the first and second deformable members of the tuned feature, providing the customized response associated with actuation of the tuned switch.

2. The tuned switch as recited in claim 1, wherein the first and second deformable members are arranged at opposing ends of the shim.

3. The tuned switch as recited in claim 2, wherein during a first period of an application of the force only the first and second deformable members are compressed and during a second period of the application of the force both the dome switch and the first and second deformable members are compressed.

4. A pressure actuated controller, comprising:

a number of dome switches arranged in a substantially linear configuration, each of the dome switches being separate and distinct from the other dome switches;

a button top, comprising a flexible shim extending across the dome switches and a number of supports supporting the flexible shim; and dampers, at least one of the dampers being disposed between each of the dome switches and the flexible shim, wherein one of the dampers is more compressible than another one of the dampers, and wherein the flexible shim cooperates with the dampers and the supports to normalize a response associated with actuation of each of the dome switches.

5. The pressure actuated controller as recited in claim 4, wherein a response associated with at least one of the dome switches is different than a response associated with another one of the dome switches.

6. The pressure actuated controller as recited in claim 4, wherein a first one of the dome switches is disposed between two other dome switches and wherein a damper associated with the first one of the dome switches is less compressible than either one of the other dampers, the compressibility differential of the dampers configured to at least partially normalize a response associated with actuation of each of the dome switches.

7. The pressure actuated controller as recited in claim 4, wherein the dome switches comprise three dome switches evenly distributed across a distance between two of the supports.

8. The pressure actuated controller as recited in claim 7, wherein the button top allows for independent actuation of each of the dome switches.

9. A mechanical switch system configured to provide a customized response to a user input, the mechanical switch system comprising:

a dome switch;

a first deformable member arranged in parallel with the dome switch;

a second deformable member arranged in parallel with both the dome switch and the first deformable member, the first deformable member providing substantially less resistance to the user input than the second deformable member; and a button top comprising a rigid shim and a layer arranged in series with both the dome switch and the deformable members, the rigid shim providing support for the layer, the button top coupled with and supported by the deformable members such that a force received at the button top is concurrently transferred by the rigid shim to the deformable members, the layer and the dome switch so that compression of the deformable members and the layer coincides with compression of the dome switch such that a tactile response of the mechanical switch system includes a combination of a tactile response of the dome switch, the layer and the deformable members.

10. The mechanical switch system as recited in claim 9, wherein the rigid shim has a substantially uninterrupted planar geometry.

11. The mechanical switch system as recited in claim 9, wherein the deformable members, the layer, and the dome switch are all concurrently compressed throughout the receipt of the force.

12. The mechanical switch system as recited in claim 9, wherein the dome switch is in contact with a surface of the rigid shim throughout receipt of the user input.

13. The mechanical switch system as recited in claim 9, wherein the first and second deformable members are arranged at opposing ends of the rigid shim.

14. The mechanical switch system as recited in claim 13, wherein the layer is coupled to a surface of the rigid shim facing the dome switch so that a force received by the rigid shim is distributed to the deformable members and the dome switch by way of the layer.

15. The mechanical switch system as recited in claim 9, wherein the first and second deformable members are configured to support the rigid shim a distance above the dome switch such that a substantially linear feedback response associated with the first and second deformable members is provided in response to the force until a surface of the layer contacts the dome switch.

16. The mechanical switch system as recited in claim 9, wherein the layer has a different tactile response than a tactile response of any one of the deformable members supporting the button top.

17. The mechanical switch system as recited in claim 15, wherein the first and second deformable members supporting the rigid shim are made of different materials.

* * * * *